US010926163B1

(12) United States Patent
Suber, III et al.

(10) Patent No.: US 10,926,163 B1
(45) Date of Patent: Feb. 23, 2021

(54) SNAKE AND HAWK CARD GAME

(71) Applicants: Edward H Suber, III, Akron, OH (US); Carey Suber, Akron, OH (US)

(72) Inventors: Edward H Suber, III, Akron, OH (US); Carey Suber, Akron, OH (US)

( * ) Notice: Subject to any disclaimer, the term of this patent is extended or adjusted under 35 U.S.C. 154(b) by 0 days.

(21) Appl. No.: 16/822,007

(22) Filed: Mar. 18, 2020

(51) Int. Cl.
*A63F 1/00* (2006.01)
*A63F 1/02* (2006.01)
*A63F 1/04* (2006.01)

(52) U.S. Cl.
CPC ..... *A63F 1/02* (2013.01); *A63F 1/00* (2013.01); *A63F 2001/001* (2013.01); *A63F 2001/0416* (2013.01); *A63F 2001/0475* (2013.01)

(58) Field of Classification Search
CPC ..... A63F 2001/001; A63F 2001/0416; A63F 2001/0475
USPC ..... 273/292, 303, 304, 306, 308
See application file for complete search history.

(56) References Cited

U.S. PATENT DOCUMENTS

| | | | | |
|---|---|---|---|---|
| 1,629,256 | A * | 5/1927 | Cohen | A63F 1/02 273/303 |
| 5,112,059 | A * | 5/1992 | Mundle | A63F 1/02 273/292 |
| 6,206,375 | B1 * | 3/2001 | Wichinsky | A63F 3/00157 273/274 |
| 7,644,925 | B2 * | 1/2010 | Hughes | A63F 1/00 273/292 |
| 2007/0090597 | A1 * | 4/2007 | Sharlow | A63D 15/20 273/292 |
| 2009/0011825 | A1 * | 1/2009 | Lima | G07F 17/3211 463/27 |

* cited by examiner

*Primary Examiner* — Benjamin Layno
(74) *Attorney, Agent, or Firm* — Edward H. Suber, III; Carey Suber

(57) ABSTRACT

The present invention relates generally to a card game. A card game has sixty cards identified by either its numerical value from one to fifteen or on point value you will be rewarded when it's time to calculate your score. The cards are two sided and include four different colors: red, blue, green, and yellow. The game will also have eight picture cards. The game is played with four players and ends when a player scores two hundred points. Even though the game is played with four players, there are two to a team. The teams may change on each round. The winner of the game is the individual player who has the least amount of points when another player reaches or exceeds two hundred points.

2 Claims, 2 Drawing Sheets

SNAKE AND HAWK CARD GAME

FIELD OF INVENTION

The present invention relates to a card game. More particularly, this invention relates to a set of playing cards' having a series of cards including various numbers, values, pictures, and characters that, when one color and picture are combined it results in a sum total.

BACKGROUND

Traditional cards can be dated back to the ninth century AD. Games today are often played with a deck of 52 playing cards with four suits: clubs, spades, hearts, and diamonds. These cards also include face cards Jack, Queen and King. You can play a variety of different card games with traditional playing cards. They are enjoyable, educational and family friendly. Card games are designed for social activity and strategic play. They can be a source of tension release or social integrating. Affective motivations are positively associated with card playing.

A search of the prior art did not disclose any patents that read directly on the claims of the instant invention; however, the following references were considered related:

U.S. Pat. No. 1,727,800a relates to card decks for playing games and particularly to playing cards U.S. Pat. No 821,781a relates to playing-cards, and has for its object the production of a pack or set of cards in which the number of combinations desired in playing a game may be materially increased without increasing the number of cards in an ordinary pack.

U.S. Pat. No. 1,798,672 shows a pack of cards having a diagonal strip dividing them into two areas, but each area represents the same denomination of card.

U.S. Pat. No. 1,557,284A A deck of playing cards each having the usual suit and value markings thereon to effect or indicate the mode of play of the standard card games U.S. Pat. No. 5,887,873 entitled "Unique Deck of Playing Cards" Various designs for playing card decks and methods of playing are disclosed in the prior art.

U.S. Pat. No. 2,265,334A relates generally to a card game and more specifically to a word and sentence forming game played with cards representing initial and final consonants and consonant combinations, and vowels and vowel combinations.

U.S. Pat. No. U.S. Pat. No. 5,125,667A A card game uses cards having a plurality of colors and face values, with all face values being odd numbers U.S. Pat. No. 20140018140A1 A method is provided for playing a card game using a deck of cards with rules to define a value of the cards in the deck, in accordance with an example.

New card games have been introduced and have been around for centuries and consequently the need has been felt for providing new and improved card games for family enjoyment.

SUMMARY OF THE INVENTION

The present invention relates generally to a card game. The cards have two sides: front side A and back side B. The present invention discloses a new set of sixty playing cards wherein some of the cards are picture cards and other cards are numerically valued cards. The back side B of all cards has the logo of a snake in a "S" shape. The card deck will include 15 cards of each color: red, blue, green and yellow.

The card deck will include eight picture cards that are colored as two red, two blue, two green, and two yellow. In the illustrated embodiment, four of the picture cards will include a picture of a snake, one of each color: red, blue, green and yellow. In the illustrated embodiment, four of the picture cards will include a picture of a hawk, one of each color: red, blue, green and yellow.

During different parts of the embodiment it would seem that an individual will recognize other embodiments. Hence, this present embodiment is capable of differentiating from other recognizable embodiments. Accordingly, the visualizations and game play may be slightly modified depending on restrictions.

DETAILED DESCRIPTION OF INVENTION

Figure 1:
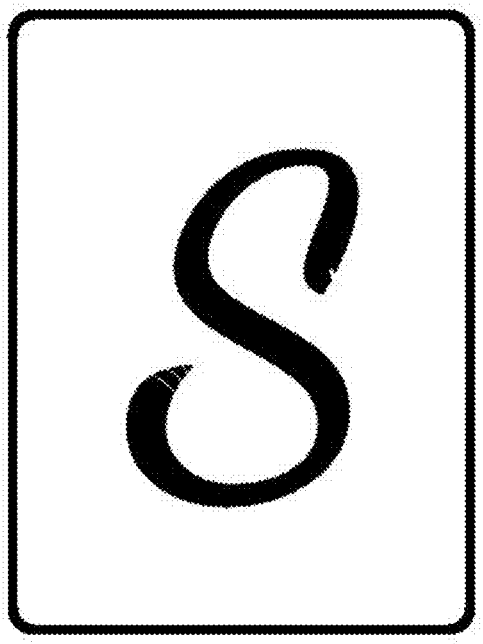
FIG. 1 shows the Back side B, perspective view of the logo printed on all cards
Figure 2:
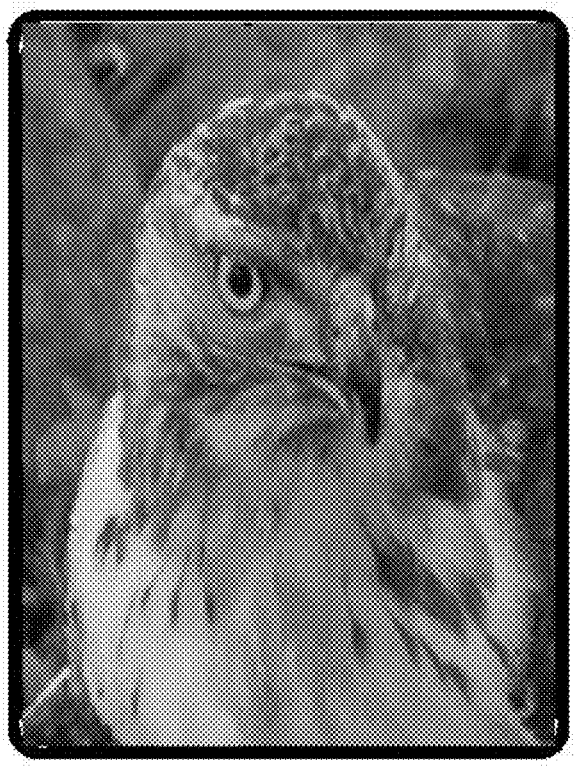
FIG. 2 shows the front side A, perspective view of a picture card in a set of playing cards; said cards have a picture of a hawk on four different cards that have a color red, blue, green and yellow.
Figure 3:
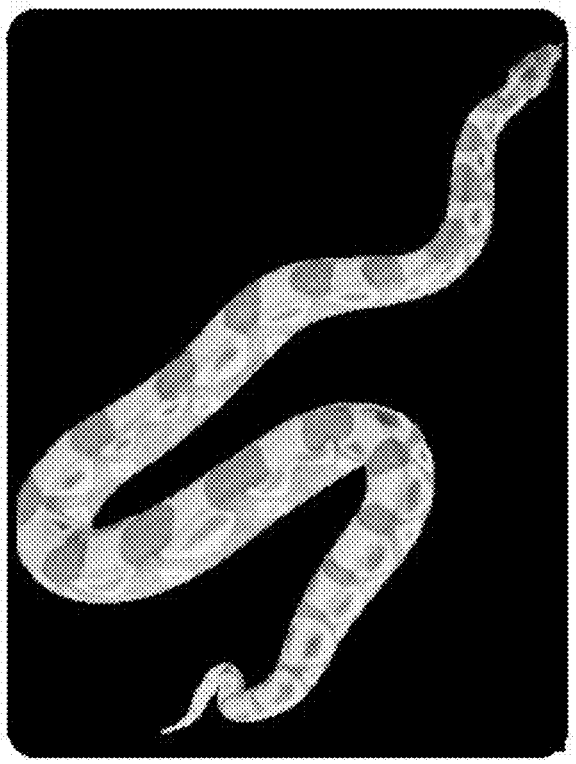
FIG. 3 shows the front side A, perspective view of a picture card in a set of playing cards; said cards have a picture of a snake on four different cards that have a color red, blue, green and yellow.
Figure 4:
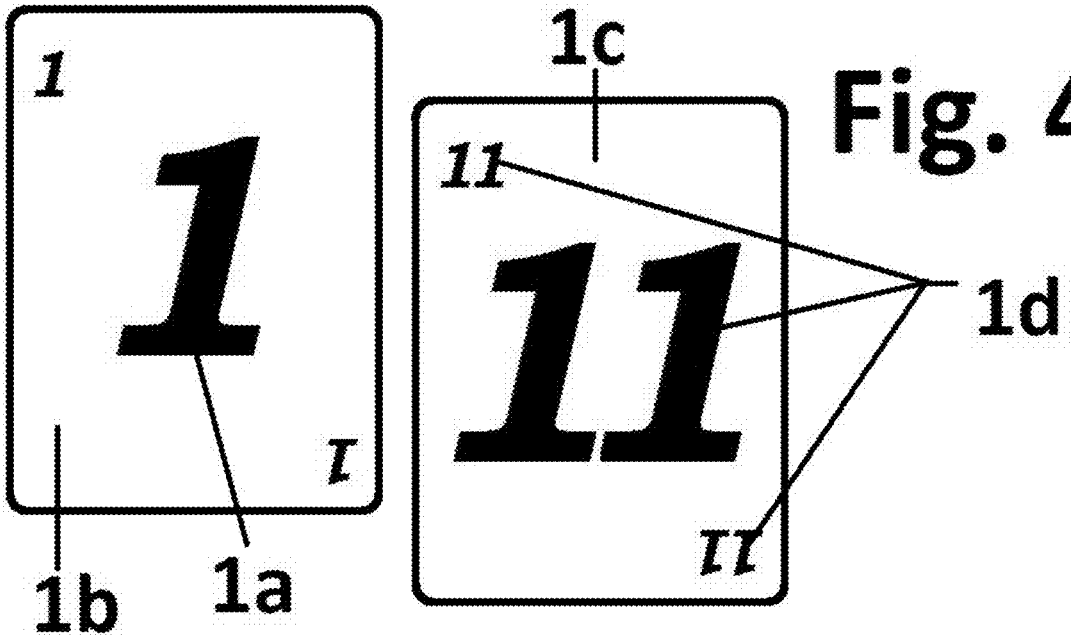
FIG. 4 shows the front side A, perspective view of a valued card in a set of playing cards; said cards will either have the background 1*b* colored red, blue, green and yellow and the numerical values 1*a* colored black or white, or they will have the numerical values 1*d* colored red, blue, green and yellow and have a background 1*c* colored white

In a set of playing cards the deck will consist of different numerical values, picture cards and four colors red, blue, green, and yellow. There are a total of sixty playing cards. Each deck will include fifteen cards of each color red, blue, green and yellow. Each color group will include thirteen cards with numerical values, a picture card of a snake and a picture card of a hawk. The card game is played with four players. The dealer will shuffle the cards and deal out all of the cards in a clockwise order. After the cards are dealt, all players can look at their cards and begin to organize them the way they choose, usually by color and value. Each player will then remove three cards from their hand and place them in the center of the table, making a total of four piles of three. Players can choose to put all three cards in one pile or two cards in one pile with the third card going to a different pile or a player can choose to put all three cards in different piles.

Once all four players have removed three cards of their choice to the four piles in the center of the table, the dealer will distribute one pile to each of the four players. Each player will add the new 3 cards to their respective hands. The dealer will then declare a partner for the round, creating team A. The other two remaining players will be partners, creating team B. Partners can change at the end of each round after the score is totaled for the round and a new dealer begins the next round.

The dealer will now declare a color. Whatever color the dealer declares for that round is considered the snake color.

Game play is started to the left of the dealer. The player to the left can start with any one card from their hand of cards. Play continues to the left. All players must then follow the same color as the card that was first played. The player who played the highest numerically valued card wins all four cards. If a player doesn't have the color that was lead by the first player, the player can choose to play any other card in their hand. The next card is then played by the player that won the last group of cards.

The card deck will have eight different picture cards: four snakes and four hawks, one of each color red, blue, green, and yellow. The snakes and hawks have to follow color like any other card. Snakes carry a numerical value of three for round play. Hawks carry a numerical value of eight for round play. In addition, there are no number threes or eights in the deck of cards.

The score is totaled by adding up the total number of suited color values, hawks and snakes the player and the player's partner won during the round. The round is over when all cards are played. Both players from the same team will receive the same score value for the round. Each declared color card with a numerical value is worth one point. For every hawk collected during the round teammates will score minus 3 to their score. For every snake collected during the round players will add ten to their score. The snake of the declared color adds an extra five points making it a total of fifteen points.

If a team is skilled enough to collect all snakes, each of the team members may deduct fifty from their respective scores. The team still must add any additional declared colors collected. The total snake value if you have all four snakes is negative fifty.

An example of scoring for one round could be: Team A won rounds resulting in the collecting of 5 snake color cards (1 point each), 3 snake cards (10 points each), and 2 hawk cards (negative 3 points each). Team B won rounds resulting in the collecting of 8 snake color cards (1 point each), the snake card of the declared snake color (10 points plus 5) and 2 hawk cards (negative 3 points each). Each player of team A receives 29 points to be added to their respective individual scores. Each player of team B receives 17 points to be added to their respective individual scores.

After the points are calculated and added to each player's totals, the game continues if no individual player has reached 200 points. If the game is still in play, the player to the left of the last dealer becomes new dealer. The new dealer will shuffle all of the cards and resume game play as previously described. The new dealer will choose a partner as previously described. The partner for this round may be the same as before or a new partner.

The player with the least amount of points wins the game. The game is over whenever any player accumulates or goes over two hundred points. The total number of points at the end of the round should add to and can't exceed forty six, unless all snakes are taken by one team.

The invention claimed is:

1. A set of playing cards comprising:

A group of cards consisting of single-valued cards wherein each single-valued card is representative of a playing card value of a playing card suit selected by colors red, blue, green, and yellow, consisting of fifty two single-valued numerical cards and eight picture cards, each group of colored suits consisting of numerical valued cards of one, two, four, five, six, seven, nine, ten, eleven, twelve, thirteen, fourteen and fifteen, wherein there is no three or eight cards in each group of colored suits, and each group of colored suits consisting of two picture cards consisting of a snake and a hawk.

2. A method of playing a card game with a number of four players comprising the steps of:

a. Providing a deck of cards consisting of 60 cards including a group of cards consisting of single-valued cards wherein each single-valued card is representative of a playing card value of a playing card suit selected by colors red, blue, green, and yellow, consisting of fifty-two single-valued numerical cards and eight picture cards, each group of colored suits consisting of numerical valued cards of one, two, four, five, six, seven, nine, ten, eleven, twelve, thirteen, fourteen and fifteen, wherein there is no three or eight cards in each group of colored suits, and each group of colored suits consisting of two picture cards consisting of a snake and a hawk;

b. a round begins by choosing a dealer and dealer deals a first hand of 15 cards to each player, dealing out all cards;

c. the four players discard three chosen cards from their own dealt hands into four discard piles in any combinations;

d. the dealer assigns said four piles of three cards to each of the four players;

e. each player adds the assigned three cards from the dealer to their existing cards to make their new hand of play;

f. the dealer declares one partner from the three other players to create a team and a second team is created from the remaining two players; the teams may change as the dealers change;

g. the dealer declares one color suit to become the snake color;

h. the player to the left of the dealer begins game play by playing a card of their choice and game play continues in a clockwise direction;

i. each player in order plays a card to follow the same color as the first card played; if a player does not have a card of the played color, the player may play any other card of their choice;

j. a player wins the round by playing the highest valued card of the leading color; if a snake picture card is played of the same color, the card value is 3; if a hawk picture card is played of the same color, the card value is 8; the player who wins the hand will collect the four played cards and set them to the side for later scoring;

k. the winning player of the last hand begins the next play; gameplay ends when all cards have been played;

l. After the round is complete, the scores are calculated for each team; 1 point is awarded for each numerically valued card collected of the declared snake color; 10 points are awarded for each snake picture card collected; 5 additional points are awarded for the snake picture card collected of the declared snake color; a negative 3 points are awarded for each hawk picture card collected; if a team collects all 4 snake picture cards, each team member is awarded a negative 50 point bonus; the total of the points between the two teams should total 46 points, unless a team collected all snake picture cards;

m. the total points of each team is added to their respective individual point totals; game play continues until a player reaches or exceeds 200 points; the player with the least amount of points is declared the winner of the game.

* * * * *